US007458106B2

(12) United States Patent
Yue

(10) Patent No.: US 7,458,106 B2
(45) Date of Patent: Dec. 2, 2008

(54) WARMING GLOVE

(76) Inventor: Steven Yue, 7F, No. 235, Hu-Lin St., Taipei (TW)

( * ) Notice: Subject to any disclaimer, the term of this patent is extended or adjusted under 35 U.S.C. 154(b) by 47 days.

(21) Appl. No.: 11/502,877

(22) Filed: Aug. 11, 2006

(65) Prior Publication Data

US 2007/0174946 A1 Aug. 2, 2007

(30) Foreign Application Priority Data

Jan. 13, 2006 (CN) ..... 2006 1 0001137

(51) Int. Cl.
*A41D 19/00* (2006.01)
*A41D 13/005* (2006.01)
*A41D 27/02* (2006.01)

(52) U.S. Cl. ..... 2/159; 2/458; 2/160; 2/164

(58) Field of Classification Search ..... 2/159, 2/160, 161.1, 161.2, 161.6, 162, 164–167
See application file for complete search history.

(56) References Cited

U.S. PATENT DOCUMENTS 5,620,621 A * 4/1997 Sontag ..... 219/211
6,060,693 A * 5/2000 Brown ..... 219/211
6,141,801 A * 11/2000 Helenick ..... 2/159
6,239,410 B1 * 5/2001 Tackore ..... 219/211
6,389,681 B1 * 5/2002 Rock et al. ..... 29/611
6,548,789 B1 * 4/2003 Rock et al. ..... 219/545
7,002,104 B2 * 2/2006 Gilligan et al. ..... 219/211
7,105,782 B2 * 9/2006 Yue ..... 219/528
7,251,837 B1 * 8/2007 Horton ..... 2/160
2003/0221238 A1 * 12/2003 Duboff et al. ..... 2/160
2004/0237170 A1 * 12/2004 Yamazaki et al. ..... 2/159
2004/0244090 A1 * 12/2004 Langer ..... 2/160
2007/0220653 A1 * 9/2007 Mack et al. ..... 2/159

* cited by examiner

*Primary Examiner*—Bobby H Muromoto, Jr.
(74) *Attorney, Agent, or Firm*—Ladas & Parry, LLP

(57) ABSTRACT

A warming glove has a glove body including a palm side sheet, a back side sheet, and a connection member interconnecting lateral ends of the palm and back side sheets. The glove body has a wrist portion, a palm portion, a thumb portion, and finger portions. The lateral ends include lateral sides of the wrist, palm, thumb and finger portions. The connection member extends continuously and laterally from the lateral sides of the wrist portion to the lateral sides of the palm portion and from the lateral sides of the palm portion to the lateral sides of the thumb and finger portions. A heating element is disposed in the connection member. Preferably, the connection member is a fabric sleeve that receives loosely the heating element.

9 Claims, 4 Drawing Sheets

WARMING GLOVE

CROSS-REFERENCE TO RELATED APPLICATION

This application claims priority of Chinese application no. 200610001137.4, filed on Jan. 13, 2006.

BACKGROUND OF THE INVENTION

1. Field of the Invention

The invention relates to a warming glove, and more particularly to a durable and stretchable warming glove.

2. Description of the Related Art

Gloves can be classified into two categories: one for protecting the hands of users from being injured while at work and the other for keeping the hands of users warm. The conventional warming glove, as shown in FIG. 1, comprises a glove body 1 having a thumb portion 6, finger portions 7, a palm portion 10, in which an electrical heating plate 11 is provided, and a wrist portion 12, on which two terminals 3, 4 are provided for electrical connection with a battery (not shown in FIG. 1) and for electrical connection to the electric heating plate 11 through a conductor 5. Thus, when a battery is electrically connected to the terminals 3, 4, the heating plate 11 generates heat, as a result of which the hand of the user can be kept warm. However, such a conventional glove has some deficiencies. For example, since the heat is generated only from the heating plate 11, considerable time is spent for transferring heat from the location of the heating plate 11 to the entire glove body 1. Thus, the user always encounters a problem in that heat is distributed unevenly. On the other hand, gloves are generally made of a stretchable and contractible fabric so as to provide elasticity and softness that will comfort users during work or exercise. However, the heating plate 11 provided in the aforesaid conventional glove is rigid and thus, can cause discomfort to the user. Moreover, the heating plate 11 is liable to displace upon frequent stretching or pulling of the glove. At the worst, the heating plate 11 can even break and lose its heat generating properties. Further improvements in the warming glove are thus desirable.

SUMMARY OF THE INVENTION

Therefore, an object of the present invention is to provide a warming glove that provides good wearability while still incorporating a heating element durable to endure frequent stretching and bending of the glove.

Another object of the present invention is to provide a more durable warming glove compared to the prior art.

Accordingly, the present invention provides a warming glove which comprises a glove body including a palm side sheet, a back side sheet, and a connection member interconnecting lateral ends of the palm and back side sheets. The glove body has a wrist portion, a palm portion, a thumb portion, and finger portions. The lateral ends include lateral sides of the wrist, palm, thumb and finger portions. The connection member extends continuously and laterally from the lateral sides of the wrist portion to the lateral sides of the palm portion and from the lateral sides of the palm portion to the lateral sides of the thumb and finger portions. The warming glove further comprises a heating element disposed in and extending along the connection member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
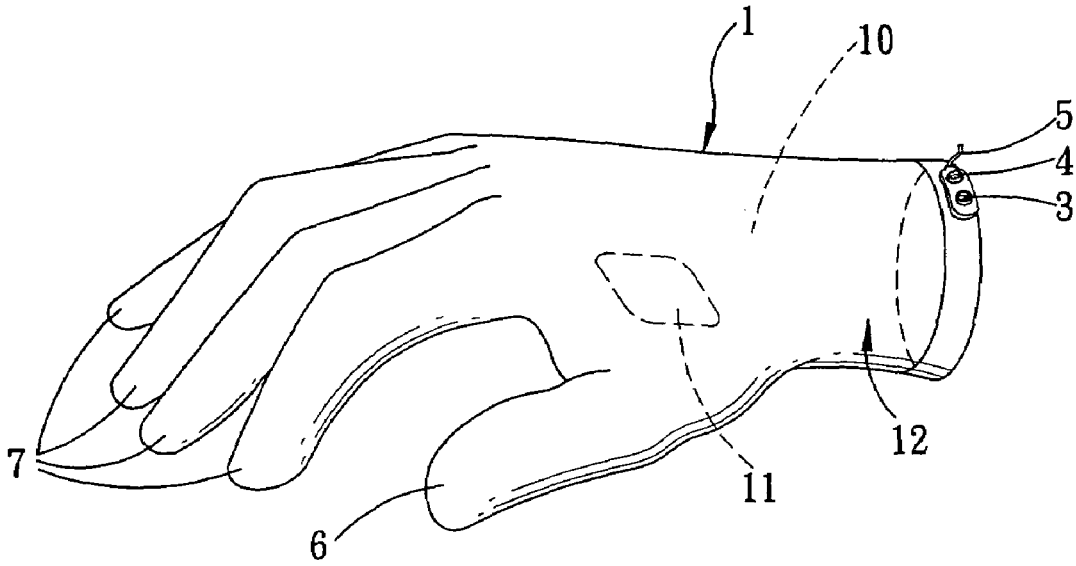
FIG. 1 PRIOR ART
FIG. 1 is a perspective view of a conventional warming glove.
Figure 2:
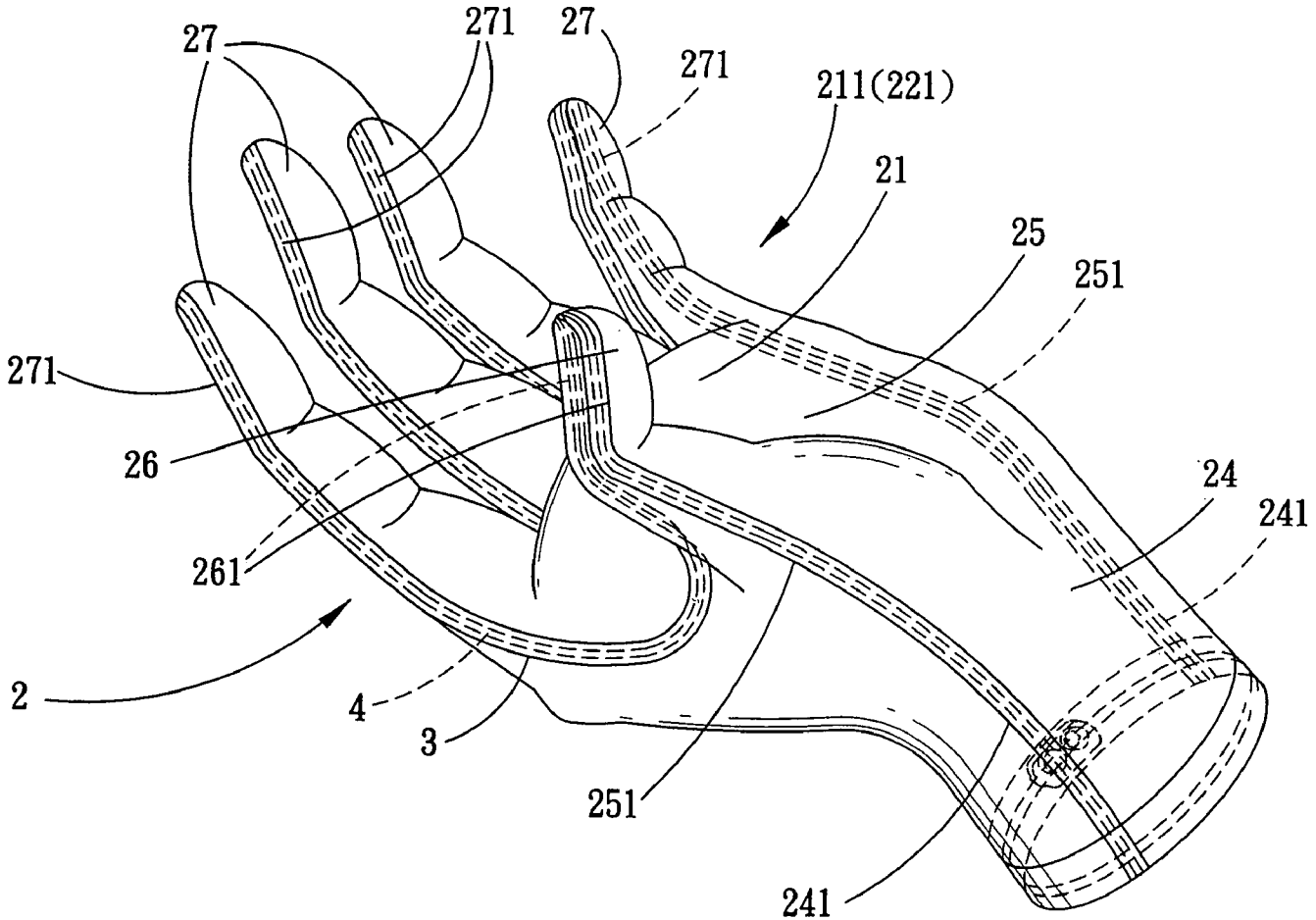
FIG. 2 is a perspective view of a warming glove embodying of this invention.
Figure 3:
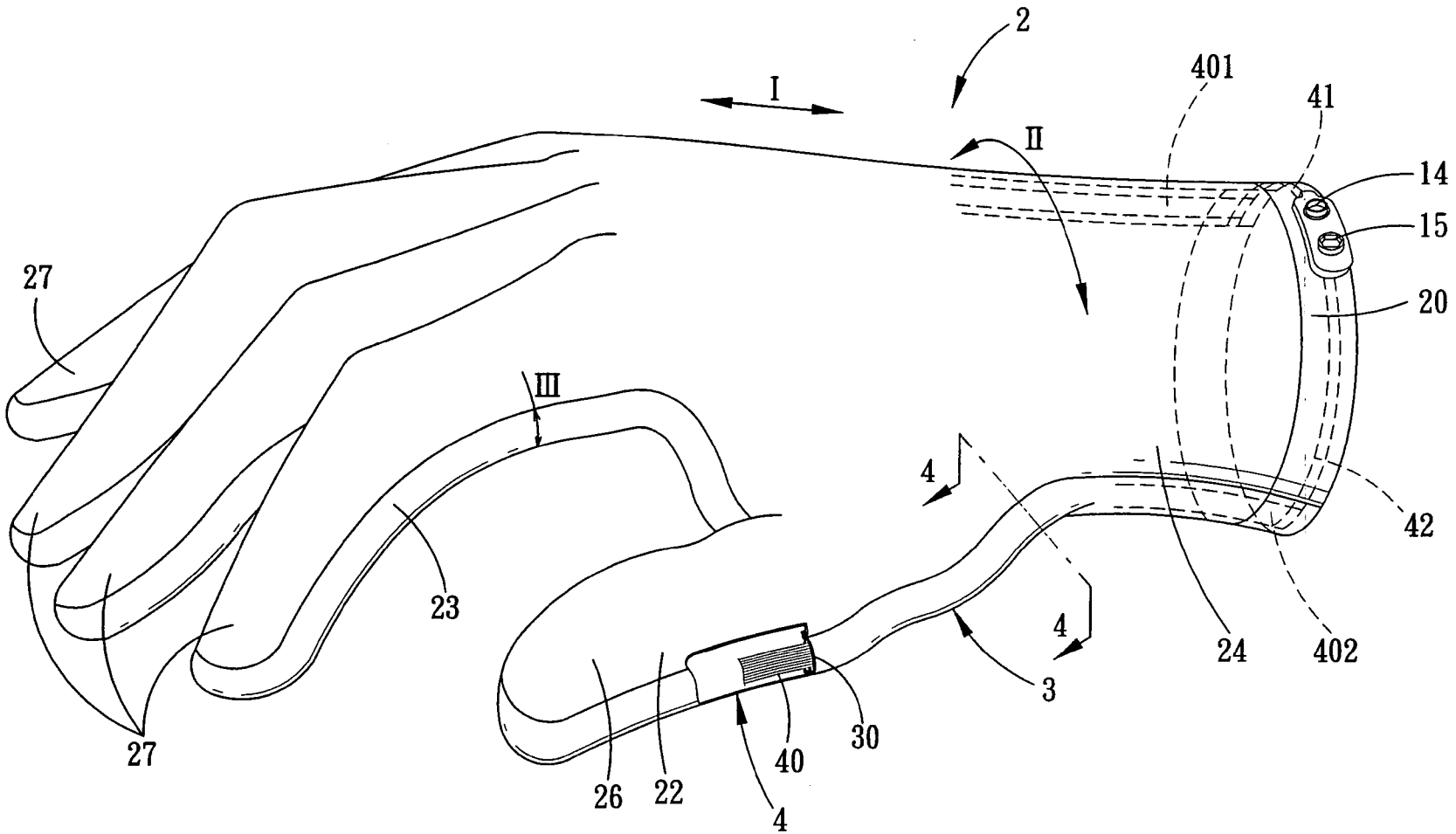
FIG. 3 is another perspective view of the warming glove of FIG. 2.
Figure 4:
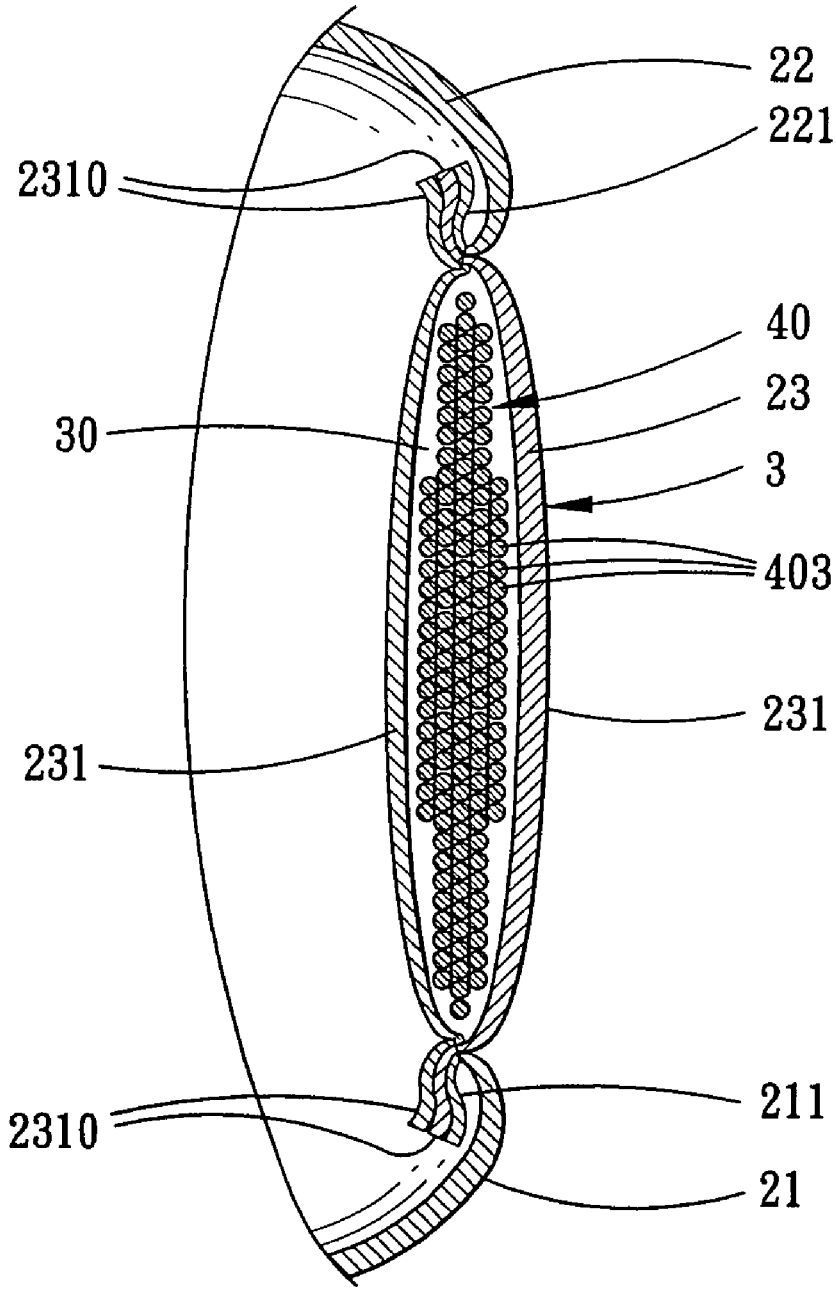
FIG. 4 is a sectional view taken along the line 4-4 of FIG. 3.

As shown in FIGS. 2, 3 and 4, the preferred embodiment of a warming glove of this invention comprises a glove body 2 including a palm side sheet 21, a back side sheet 22, and a connection member 3 sewn to and interconnecting lateral ends 211, 221 of the palm and back side sheets 21, 22. The glove body 2 has a wrist portion 24, a palm portion 25, a thumb portion 26, and finger portions 27. The lateral ends 211, 221 of the palm and back side sheets 21, 22 include two lateral sides 241 of the wrist portion 24, two lateral sides 251 of the palm portion 25, and lateral sides 261, 271 of the thumb portion 26 and the finger portions 27. The connection member 3 extends continuously and laterally from the two lateral sides 241 of the wrist portion 24 to the two lateral sides 251 of the palm portion 25 and from the two lateral sides 251 of the palm portion 25 to the lateral sides 261, 271 of the thumb and finger portions 26, 27.

In this embodiment, the connection member 3 has an elongated fabric sleeve 23 that is made by sewing together two fabric strips 231. Each fabric strip 231 has two opposite longitudinal marginal ends 2310 that are sewn respectively to the marginal ends 2310 of the other fabric strips 231. The marginal ends 2310 of the fabric strip 231 are also sewn respectively to the lateral ends 211, 221 of the palm side and back side sheets 21, 22. While the connection member 3 in this embodiment is the fabric sleeve 23 made by sewing together two fabric strips 231, it is contemplated that the fabric sleeve 23 could be made from a knitted tubular fabric, or a single fabric sheet.

The heating element 4 is preferably disposed loosely within a space 30 inside the fabric sleeve 23. The heating element 4 extends continuously along the connection member 3 from the wrist portion 24 to the thumb and finger portions 26, 27 through the palm portion 25. The heating element 4 may be a metal conductor or a carbon conductor. In this embodiment, the heating element 4 is a carbon conductor 40 that is loosely received within the fabric sleeve 23 so that the carbon conductor 40 is freely movable relative to the fabric sleeve 23. Preferably, the heating element 4 is not fastened to the fabric sleeve 23 by any means, such as sewing or bonding.

The carbon conductor 40 has two opposite ends 401, 402 extending respectively to the two lateral sides 241 of the wrist portion 24. The ends 401, 402 are connected respectively two connecting conductors 41, 42 which are in turn connected respectively to positive and negative terminals 14, 15 disposed at the open end 20 of the wrist portion 24 for electrical connection to a battery (not shown). The carbon conductor 40 includes a plurality of carbon filaments 403 that extend from the end 401 to the end 402 of the carbon conductor 40. The carbon filaments 403 are separated from each other between the ends 401, 402, and are bundled using tying elements, such as sleeves (not shown), at the ends 401, 402. When the carbon conductor 40 generates heat along the connection member 3, the heat can reach thumb and fingers of the user at the same time. Therefore, quick and uniform heating can be achieved.

It is preferable that the palm and back side sheets 21, 22 are stretchable and contractible along a first direction (I) parallel to a line that extends from the wrist portion 24 to the finger portions 27 and a second direction (II) perpendicular to the first direction (I). It is also preferable that the connection member 3 is stretchable and contractible in the first direction (I) and a third direction (III) perpendicular to the first and second directions (I) and (II).

In view of the aforesaid, the warming glove according to the present invention has the following advantages:

1. Since the palm and back side sheets 21, 22 are stretchable and contractible along the first direction (I) and the second direction (II), and since the connection member 3 is stretchable and contractible along the first direction (I) and the third direction (III), the warming glove of the present invention can be perfectly fitted to the hand of the user when worn.
2. The provision of the heating element 4 does not affect adversely the wearability and appearance of the warming glove since the heating element 4 is loosely disposed within the space 30 inside the fabric sleeve 23 of the connection member 3.
3. Because the carbon conductor 40 is not fixed to the connection member 3, even when the palm and back side sheets 21, 22 and the connection member 3 are stretched excessively in the second and third directions (II) and (III), the stretching thereof will not affect and break the carbon conductor 40. In addition, because the connection member 3 has sufficient resistance to pulling forces, when the user takes the glove off by pulling at the finger portions 27 of the warming glove in the first direction (I), the carbon conductor 40 will likewise not break.
4. The carbon conductor 40 contained within the warming glove does not break easily when the warming glove is folded frequently. Thus, the warming glove is durable.

While the present invention has been described in connection with what is considered the most practical and preferred embodiment(s), it is understood that this invention is not limited to the disclosed embodiment(s) but is intended to cover various arrangements included within the spirit and scope of the broadest interpretations and equivalent arrangements.

I claim:

1. A warming glove comprising:

a glove body including a palm side sheet, a back side sheet, and a connection member interconnecting lateral ends of said palm and back side sheets, said glove body having a wrist portion, a palm portion, a thumb portion, and finger portions, said lateral ends including lateral sides of said wrist, palm, thumb and finger portions, said connection member being an elongated fabric sleeve that extends continuously and laterally from said lateral sides of said wrist portion to said lateral sides of said palm portion and from said lateral sides of said palm portion to said lateral sides of said thumb and finger portions, and that have two opposite longitudinal ends both of which extend between said lateral ends of said palm and back side sheets, one of said longitudinal ends being solely sewn to said lateral end of said palm side sheet, the other one of said longitudinal ends being solely sewn to said lateral end of said back side sheet; and a heating element disposed in and extending along said fabric sleeve.

2. The warming glove of claim 1, wherein said fabric sleeve includes two fabric strips each having two opposite longitudinal marginal ends, said marginal ends of each of said fabric strips being sewn respectively to said marginal ends of the other one of said fabric strips and being sewn respectively to said lateral ends of said palm side and back side sheets.

3. The warming glove of claim 1, wherein said heating element is disposed loosely within a space inside said fabric sleeve, and is movable relative to said fabric sleeve.

4. The warming glove of claim 1, wherein said heating element is a carbon conductor.

5. The warming glove of claim 4, wherein said carbon conductor has two opposite ends, and a plurality of carbon filaments each extending from one of said opposite ends to the other one of said opposite ends, said carbon filaments being bundled at said opposite ends and being separated from each other between said opposite ends.

6. The warming glove of claim 5, further comprising positive and negative terminals provided in said wrist portion, said opposite ends of said carbon conductor being connected to said positive and negative terminals, respectively.

7. The warming glove of claim 1, wherein said palm and back side sheets are stretchable.

8. The warming glove of claim 7, wherein said connection member is stretchable.

9. The warming glove of claim 1, further comprising positive and negative terminals disposed in said wrist portion and connected to said heating element.

* * * * *